US009052682B2

(12) United States Patent
Hisano

(10) Patent No.: US 9,052,682 B2
(45) Date of Patent: Jun. 9, 2015

(54) IMAGE FORMING APPARATUS

(71) Applicant: CANON KABUSHIKI KAISHA, Tokyo (JP)

(72) Inventor: Masato Hisano, Boise, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 73 days.

(21) Appl. No.: 13/869,830

(22) Filed: Apr. 24, 2013

(65) Prior Publication Data

US 2013/0287434 A1 Oct. 31, 2013

(30) Foreign Application Priority Data

Apr. 27, 2012 (JP) ..... 2012-102475
Apr. 2, 2013 (JP) ..... 2013-077004

(51) Int. Cl.
*G03G 15/00* (2006.01)
*G03G 21/16* (2006.01)

(52) U.S. Cl.
CPC ..... *G03G 21/1619* (2013.01); *G03G 21/1633* (2013.01)

(58) Field of Classification Search
CPC ..... G03G 21/1623; G03G 21/1633; G03G 21/1647; G03G 21/1661
USPC ..... 399/110, 114
See application file for complete search history.

(56) References Cited

U.S. PATENT DOCUMENTS

2007/0147882 A1* 6/2007 Igarashi ..... 399/110
2011/0052253 A1* 3/2011 Nieda ..... 399/110

FOREIGN PATENT DOCUMENTS

| | | | |
|---|---|---|---|
| CN | 101114143 | A | 1/2008 |
| CN | 102289164 | A | 12/2011 |
| JP | H11-157166 | A | 6/1999 |
| JP | 2000-079739 | A | 3/2000 |
| JP | 3421246 | B2 | 6/2003 |
| JP | 2006-53193 | A | 2/2006 |
| JP | 2009-271408 | A | 11/2009 |
| JP | 2010-72064 | A | 4/2010 |
| JP | 2011-95628 | A | 5/2011 |
| JP | 2011-154240 | A | 8/2011 |
| JP | 2011-230406 | A | 11/2011 |
| JP | 2012-37914 | A | 2/2012 |

* cited by examiner

*Primary Examiner* — Walter L Lindsay, Jr.
*Assistant Examiner* — Jessica L Eley
(74) *Attorney, Agent, or Firm* — Canon USA Inc IP Division

(57) ABSTRACT

When an opening and closing member is being closed, urging force which a first engaged portion of the opening and closing member receives in a direction opposite to a direction to close the opening and closing member is larger than urging force which a second engaged portion of the opening and closing member receives, and a distance in which the first engaged portion moves until the first engaged portion engages with a first engaging portion is shorter than a distance in which the second engaged portion moves until the second engaged portion engages with a second engaging portion while the first engaged portion and the second engaged portion are caused to engage with the first engaging portion and the second engaging portion, respectively, by closing the opening and closing member from an opened state of the opening and closing member.

14 Claims, 17 Drawing Sheets

IMAGE FORMING APPARATUS

BACKGROUND OF THE INVENTION

1. Field of the Invention

The present invention relates to an image forming apparatus having an opening and closing member that is able to opened with respect to an apparatus main body to open the inside of the apparatus main body.

2. Description of the Related Art

In a conventional image forming apparatus adopting an electrophotographic method, such as a copying machine, a printer, or the like, an opening and closing door (opening and closing member) is provided, which rotates with respect to the apparatus main body to be openable and closable, and opens the inside of the apparatus main body to enable maintenance such as replacement of a cartridge, or the like or jam handling.

FIG. 15 is a perspective view of a conventional image forming apparatus 901, which has the opening and closing door 904. FIG. 16A is a cross-sectional view illustrating parts of the opening and closing door 904 and the apparatus main body 901 around the opening and closing door 904, and illustrates a closed state of the opening and closing door 904. The opening and closing door 904 is opened to rotate in the direction of an arrow in FIG. 10 with a rotation shaft 904*r* as an axis. Herein, in general, the opening and closing door 904 is configured to press a member 907 in the apparatus main body 901 while closing the opening and closing door 904, to open and close a laser shutter (not illustrated) in the apparatus main body 901 or to turn on and off electrification to an interlock (not illustrated) in conjunction with opening and closing of the opening and closing door 904. As a result, the opening and closing door 904 is configured to receive reaction force Fs from the member 907 in the apparatus main body 901 while closing the opening and closing door 904. Therefore, engaged portions 905*a* and 905*b*, which engage with engaging portions 906*a* and 906*b* of the apparatus main body 901, are provided at both ends in the direction of the rotation shaft 904*r* of the opening and closing door 904 as illustrated in FIG. 16A, to keep the opening and closing door 904 being closed with respect to the apparatus main body 901.

In this configuration, for example, if a user closes the opening and closing door 904 by moving the opening and closing door 904 with force Fu along a right side of the opening and closing door 904 in FIG. 16B, the following phenomenon may occur. That is, as illustrated in FIG. 16B, at the right side of the opening and closing door 904 in FIG. 16, the engaging portion 906*b* engages with the engaged portion 905*b*, but the engaged portion 905*a* cannot engage with the engaging portion 906*a* due to the reaction force Fs at the left side of the opening and closing door 904 in FIG. 16B. In this state, the opening and closing door 904 is bent at an angle θ as compared with an initial state. This state is a state called a 'one-sided closing state' and in this state, the apparatus may not normally operate.

In particular, since the member 907, which applies the reaction force Fs to the opening and closing door 904, is mostly located at an end portion of the opening and closing door 904, the one-sided closing state easily occurs when the user operates the opening and closing door 904 by pushing a portion of the opening and closing door 904 where the member 907 is not located.

Therefore, Japanese Patent Application Laid-Open No. 2006-53193 discusses a configuration to detect the one-sided closing state by the use of a detection unit when the one-sided closing state occurs, and to prevent an image forming operation from starting when the one-sided closing state is detected.

However, in the configuration discussed in Japanese Patent Application Laid-Open No. 2006-53193, since the detection unit, which detects the one-sided closing state, needs to be provided, cost increase may be caused and the apparatus may be larger. Further, preventing the one-sided closing state by increasing rigidity of the opening and closing door is also considered, but there is a limit in increasing the rigidity of the opening and closing door in terms of cost or miniaturization.

Therefore, Japanese Patent Application Laid-Open No. 2009-271408 discusses a configuration in which the opening and closing door itself cannot be closed if the opening and closing door is not closed at a predetermined position to prevent the one-sided closing state.

However, in the configuration discussed in Japanese Patent Application Laid-Open No. 2009-271408, since the opening and closing door itself cannot be closed if the opening and closing door is not closed at the predetermined position, the user needs to perform an operation of closing the opening and closing door many times to close the opening and closing door, and there is a room for improvement of usability.

SUMMARY OF THE INVENTION

The present invention is directed to an image forming apparatus that can improve usability in closing an opening and closing member while preventing a one-sided closing state from occurring.

According to an aspect of the present invention, an image forming apparatus includes an opening and closing member configured to rotate with respect to an apparatus main body to allow opening an inside of the apparatus main body, a first engaging portion and a second engaging portion provided in the apparatus main body, a first engaged portion and a second engaged portion provided in the opening and closing member and configured to engage with the first engaging portion and the second engaging portion of the apparatus main body, respectively, and an urging unit configured to urge the opening and closing member in a direction opposite to a direction to close the opening and closing member, wherein the first engaged portion and the second engaged portion are arranged in parallel in a direction of a rotation shaft of the opening and closing member, and when the first engaging portion and the first engaged portion engage with each other and the second engaging portion and the engaged portion engage with each other, the opening and closing member is held in a closed state, wherein pressing force which the first engaged portion of the opening and closing member receives from the urging unit when the opening and closing member is being closed is larger than the pressing force which the second engaged portion receives from the urging unit, and wherein a distance which the first engaged portion moves until the first engaged portion engages with the first engaging portion is shorter than a distance which the second engaged portion moves until the second engaged portion engages with the second engaging portion while the first engaged portion and the second engaged portion are caused to engage with the first engaging portion and the second engaging portion, respectively, by closing the opening and closing member from an opened state of the opening and closing member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

First, an entire configuration of an image forming apparatus according to a first exemplary embodiment of the present invention will be described.

Figure 1A:
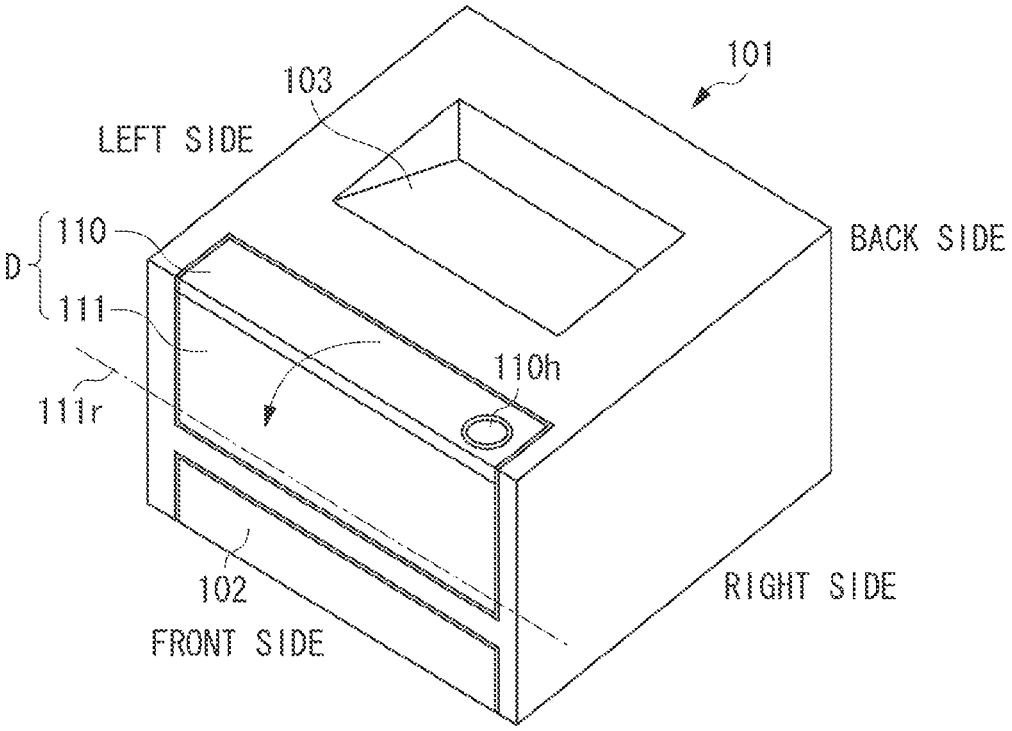
FIG. 1A is a perspective view of an image forming apparatus in a closed state of an opening and closing door with respect to an apparatus main body.
Figure 1B:
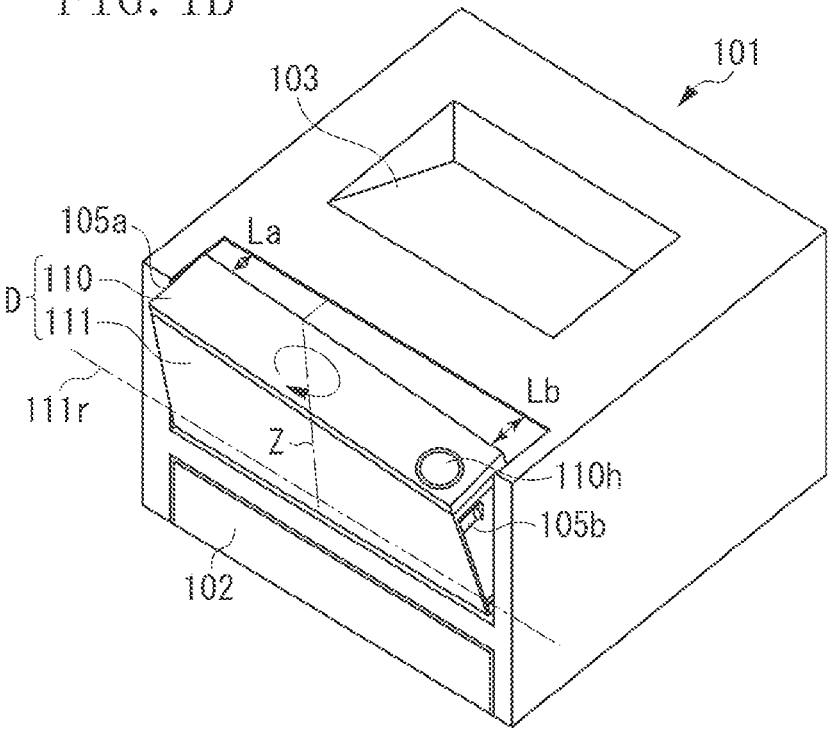
FIG. 1B is a perspective view of an image forming apparatus in an opened state of the opening and closing door with respect to the apparatus main body.

First, an external configuration of the apparatus is described with reference to FIG. 1. FIGS. 1A and 1B are perspective views of an image forming apparatus, FIG. 1A illustrates a closed state of an opening and closing door D with respect to an apparatus main body, and FIG. 1B illustrates an opened state of the opening and closing door D with respect to the apparatus main body. In an image forming apparatus 101, when a portion where the opening and closing door D is located is a front plane, a plane at a right side based on the front plane is a right plane, a plane at a left side is a left plane, and a surface at a side facing the front plane is a back plane. Further, in the following description, the left and right planes will be described when viewed based on the front plane (toward the front surface).

A feeding tray 102 that loads a sheet material is provided at a lower part of an apparatus main body 101, and a discharge tray 103 that discharges the sheet material is provided at an upper part of the apparatus main body. The opening and closing door D (opening and closing member) for performing replacement of consumables or handling of paper jamming is a member in which a front cover part (first member) 111 and an upper cover part (second member) 110 are integrated with each other, on the front surface of the apparatus main body 101. A button 110*h* for disengaging the apparatus main body 101 and the opening and closing door D from each other is provided at the upper cover part 110. A rotation shaft 111*r* as a rotation shaft of the opening and closing door D is provided at the front cover part 111. A user disengages the apparatus main body 101 and the opening and closing door D from each other by pushing the button 110*h* and pulls a holding part to open the opening and closing door D to a front surface side (in the direction of an arrow in the figure) with the rotation shaft 111*r* as a rotational center, at the time of opening the opening and closing door D.

FIG. 1B is a perspective view illustrating the opened state of the opening and closing door D with respect to the apparatus main body 101. However, FIG. 1B illustrates a state in which the opening and closing door D is not fully opened but opened halfway. Engaged portions (first engaged portion and second engaged portion) 105*a* and 105*b* are provided at both left and right end portions of an inner surface of the front cover part 111. Although described in detail below, in the apparatus main body 101, the engaged portions 105*a* and 105*b* of the front cover part 111 engage with engaging portions (first engaging portion and second engaging portion) 106*a* and 106*b* (not illustrated) of the apparatus main body 101, at the time of closing the opening and closing door D. As a result, the opening and closing door D may be held in a closed state with respect to the apparatus main body 101. In the present exemplary embodiment, a state in which the engaged portions 105*a* and 105*b* engage with the engaging potions 106*a* and 106*b* (not illustrated) of the apparatus main body 101, respectively is defined as a closed state of the opening and closing door D, and the other state is defined as an opened state of the opening and closing door D. Further, it is configured in such a manner that a laser shutter (not illustrated) provided in a laser scanner 42 to be described below is opened and closed or electrification to an interlock (not illustrated) is turned on/off, in link with opening and closing of the opening and closing door D.

Figure 17:
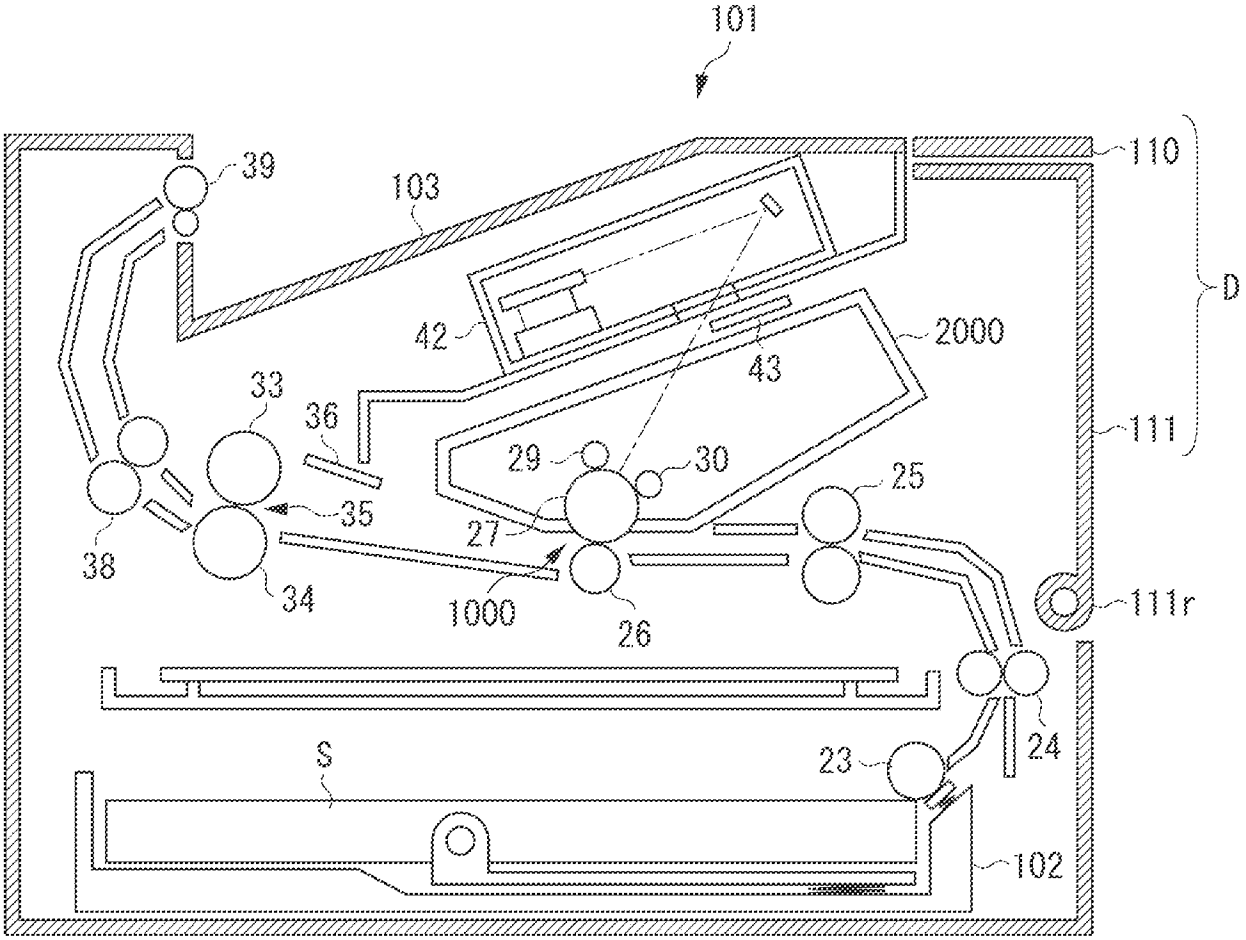
FIG. 17 is a schematic cross-sectional view of the image forming apparatus.

Subsequently, an internal configuration of the apparatus will be described. FIG. 17 is a schematic cross-sectional view of the image forming apparatus 101. The image forming apparatus 101 generally includes an image forming unit 1000 configured to transfer a toner image to a sheet S, a feeding tray 102 configured to feed the sheet S to the image forming unit 1000, and a fixing unit 35 configured to fix the toner image to the sheet S therein.

The image forming unit 1000 includes a cartridge 200, a transfer roller 26, and a laser scanner (light irradiating unit) 42 which are removably mounted on the apparatus main body 101. The cartridge 200 includes a photosensitive drum 27, a charging unit 29, and a developing unit 30.

Subsequently, an image forming operation will be described. When a control unit (not illustrated) sends a printing signal, a paper feeding roller 23 rotates counterclockwise only while feeding paper and a sheet S loaded on a paper feeding cassette 21 is carried out to the image forming unit 1000.

Meanwhile, the surface of the photosensitive drum 27 is charged by the charging unit 29. In addition, the laser scanner 42 (laser light irradiating unit) emits laser light L from a light source (not illustrated) provided therein and irradiates the laser light L onto the photosensitive drum. As a result, a latent image is formed on the surface of the photosensitive drum 27. The toner image is formed on the photosensitive drum 27 by developing the latent image by means of the developing unit 30. The toner image formed on the photosensitive drum 27 is transferred to the sheet S conveyed to a transfer nip portion formed between the photosensitive drum 27 and a transfer roller 26 by conveyance rollers 24 and 25.

The sheet S to which the toner image is transferred is sent to the fixing unit 35, heated and pressed by a fixing nip portion constituted by a heating roller 33 and a pressure roller 34 of the fixing unit 35, and the toner image on the sheet S is fixed onto the sheet. The sheet S passing through the fixing unit 35 is conveyed by discharge rollers 38 and 39 and discharged onto a discharge tray 41.

By rotating and opening the opening and closing door D around the rotation shaft 111*r*, the inside of the apparatus main body is opened, and detaching of detachable parts such as the cartridge 200, and the like or jam processing may be performed.

A shape of the opening and closing door D will be described. As illustrated in FIG. 1B, in the opening and closing door D, the rotation shaft 111*r* is axially supported on the apparatus main body 101 with the front cover part 111 being twisted while the engaged portions 105*a* and 105*b* do not engage with the engaging portions 106*a* and 106*b*. A twisted direction of the front cover part 111 is a twisted direction in which a rotational angle of the center of a virtual axis Z around the rotation shaft 111*r* is increased as the virtual axis Z is distant from the rotation shaft 111*r* from a position crossing the rotation shaft 111*r*, by considering the virtual shaft Z which passes through the center in the direction of the rotation shaft 111*r* of the front cover part 111 and is perpendicular to the rotation shaft 111*r*.

That is, since the front cover part 111 is set in the twisted direction with the opening and closing door D being opened, a relationship between a distance La between a left part of the opening and closing door D and the apparatus main body 101 and a distance Lb between a right part of the opening and closing door D and the apparatus main body is set as La<Lb. While the opening and closing door D is closed, the engaged portions 105*a* and 105*b* engage with the apparatus main body 101, and as a result, twisting of the front cover part 111 is recovered to a substantially untwisted state. Therefore, the relationship is set as La≈Lb. Further, the left and right parts of the opening and closing door D are determined based on the center of the direction of the rotation shaft 111*r* of the opening and closing door D.

Figure 2A:
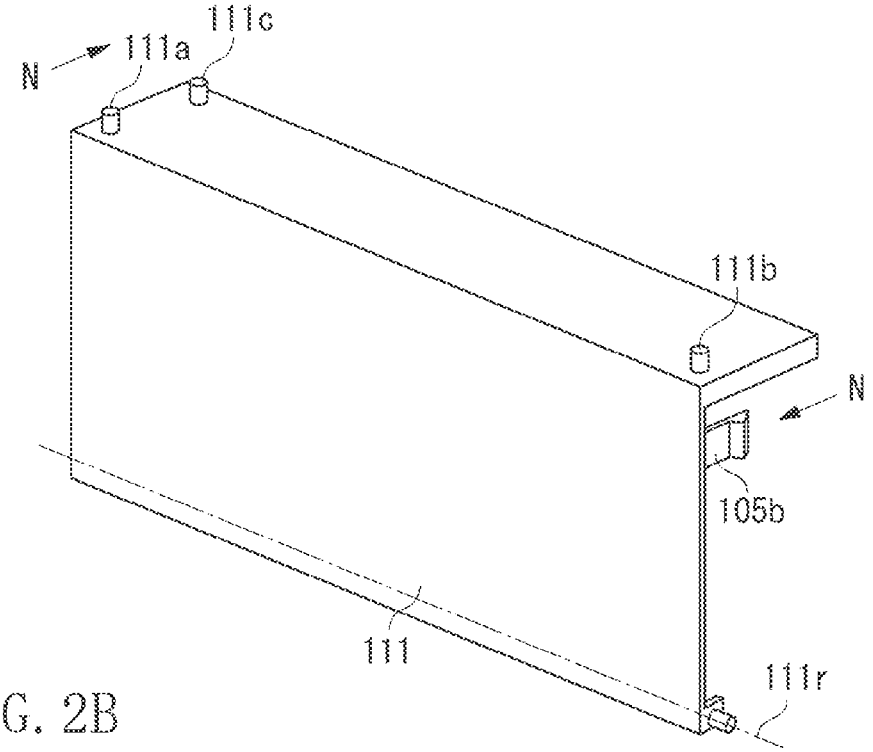
FIG. 2A is a perspective view of a front cover part.
Figure 2B:
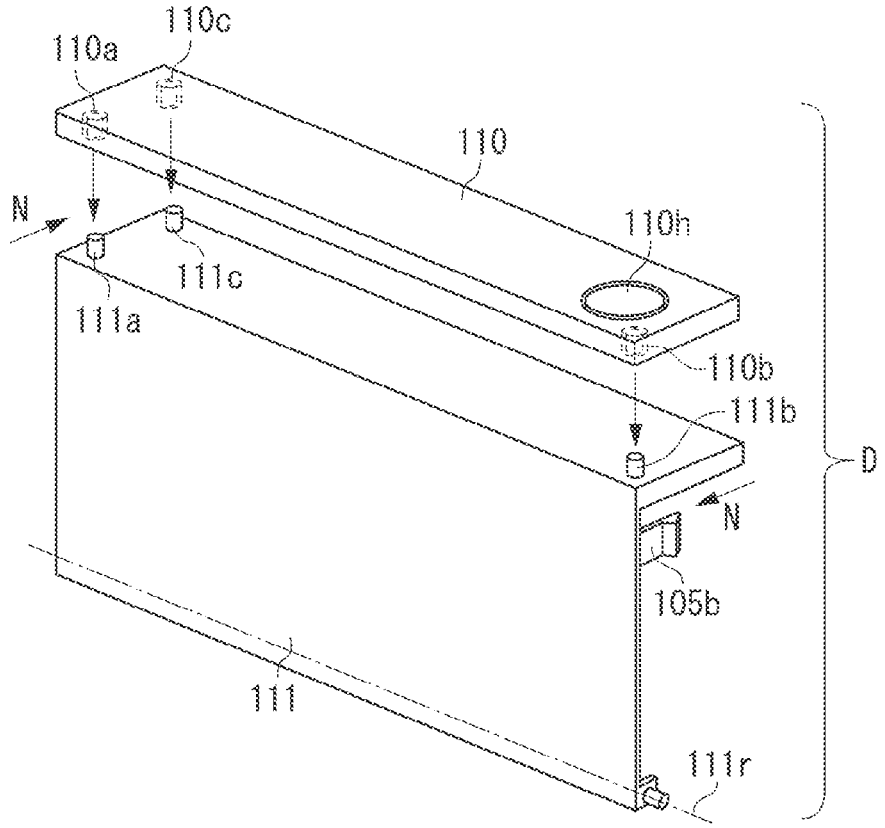
FIG. 2B is a perspective view illustrating a state before an upper cover part and the front cover part are combined with each other.

Subsequently, a method of assembling the opening and closing door D in which the front cover part 111 is twisted will be described with reference to FIGS. 2A and 2B to FIG. 4. FIG. 2A is a perspective view of the front cover part 111. FIG. 2B is a perspective view illustrating a state before the upper cover part 110 and the front cover part 111 are combined with each other. Bosses 111*a*, 111*b*, and 111*c* of the front cover part 111 fit in holes 110*a*, 110*b*, and 110*c* of the upper cover part 110 to combine the upper cover part 110 and the front cover part 111 with each other. In the present exemplary embodiment, before combining the upper cover part 110 and the front cover part 111 with each other, the front cover part 111 is twisted by pressing the left and right parts of the front cover part 111 in the direction of an arrow N of FIG. 2A. In addition, the upper cover part 110 is mounted in the twisted state, and as a result, the front cover part 111 is kept in a twist state by the fit-in of the bosses 111*a*, 111*b*, and 111*c*, and the holes 110*a*, 110*b*, and 110*c*. The reason is that the front cover part 111 and the upper cover part 110 are configured so that the upper cover part 110 is higher in rigidity than the front cover part 111 with respect to twisting in the arrow N direction while the opening and closing door D is opened.

Figure 3A:
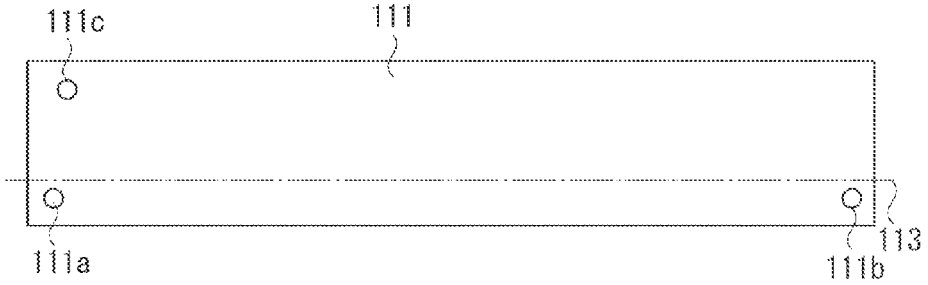
FIG. 3A is a top view of the front cover part.
Figure 3B:
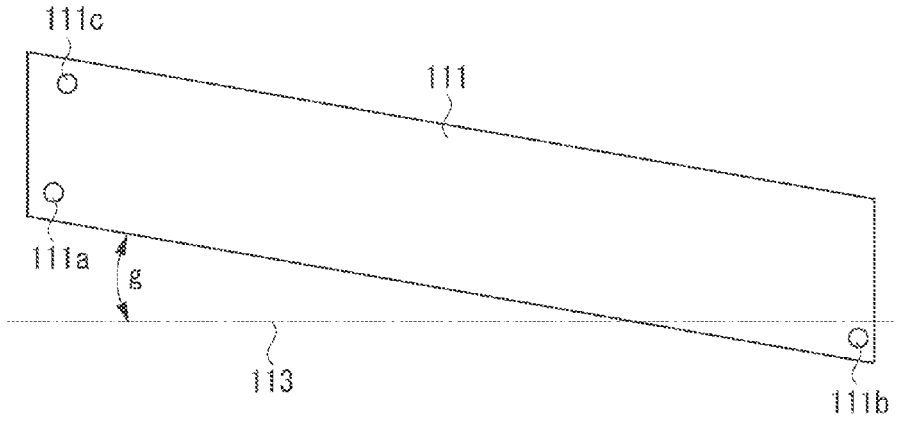
FIG. 3B is a top view of the front cover part.
Figure 4:
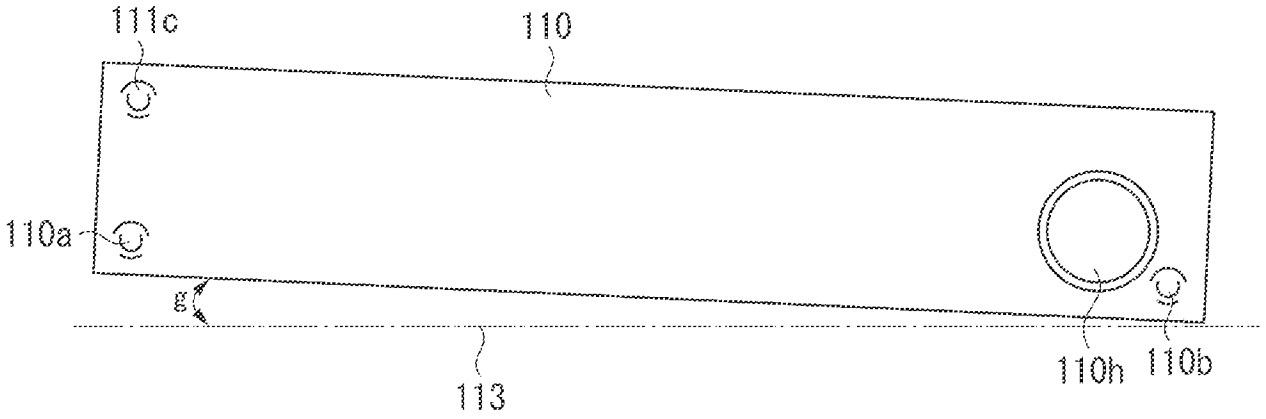
FIG. 4 is a top view of the upper cover part.

FIGS. 3A and 3B are top views of the front cover part 111. FIG. 3A illustrates a state before the front cover part 111 is twisted, and FIG. 3B illustrates a twisted state of the front cover part 111. FIG. 4 is a top view of the upper cover part 110. Further, in FIG. 3B, the twisted state is emphasized and drawn for simplification. The front cover part 111 is twisted, and as a result, the upper surface of the front cover part 111 is deformed. That is, when the upper surface before twisting is a rectangle parallel to a virtual line 113 which is parallel to the rotation shaft 111*r*, the upper surface has a shape of a parallelogram which is inclined at an angle g with respect to the virtual line 113 in the twisted state. As a result, the state before twisting and the twisted state are different from each other in relative positional relationship of the bosses 111*a*, 111*b*, and 111*c*. In addition, the relative positional relationship of the holes 110*a*, 110*b*, and 110*c* of the upper cover part 110 are configured to coincide with the relative positional relationship of the bosses 111*a*, 111*b*, and 111*c* of the front cover part 111 in the twisted state. Therefore, the holes 110*a*, 110*b*, and 110*c* of the upper cover part 110 fit in the bosses 111*a*, 111*b*, and 111*c* of the front cover part 111 in the twisted state, and the front cover part 111 is kept in the twist state. Further, the holes 110*a*, 110*b*, and 110*c* fit in the bosses 111*a*, 111*b*, and 111*c*, while the upper cover part 110 is inclined obliquely at the angle g with respect to the virtual line 113. By the aforementioned configuration, the opening and closing door D may be configured with the front cover part 111 being twisted.

Subsequently, an operation of preventing one-sided closing will be described in a configuration using the opening and closing door D configured with the front cover part 111 being twisted.

FIGS. 5A to 5C, FIG. 6, and FIGS. 7A to 7C are cross-sectional views illustrating the front cover part 111 of the opening and closing door D and a part of the apparatus main body 101 around the opening and closing door D, which are viewed from the top side of the front cover part 111.

Figure 5A:
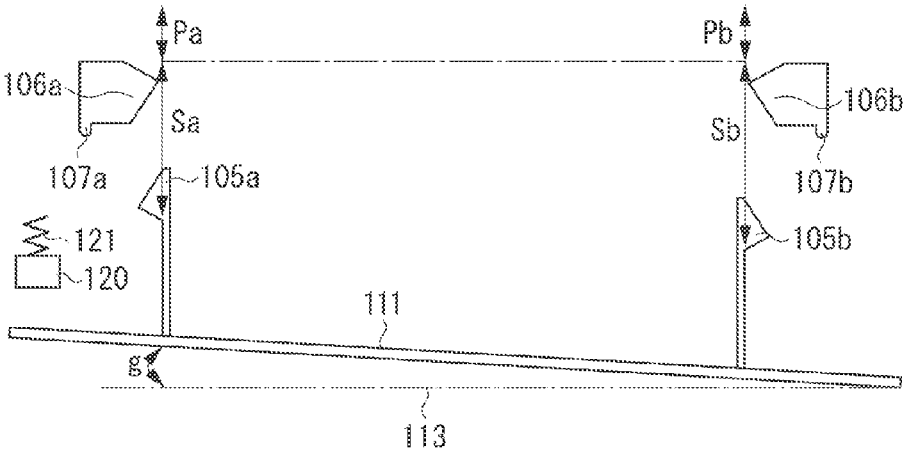
FIG. 5A is a cross-sectional view illustrating the front cover part of the opening and closing door and a part of the apparatus main body around the opening and closing door, which is viewed from the top side of the front cover part.

FIG. 5A illustrates a state in which the opening and closing door D is opened and stopped at a predetermined opening angle. That is, FIG. 5A illustrates a state in which the engaged portions 105*a* and 105*b* of the front cover part 111 do not engage with the engaging portions 106*a* and 106*b* of the apparatus main body 101. In addition, the state, in which the engaged portions 105*a* and 105*b* of the front cover part 111 do not engage with the engaging portions 106*a* and 106*b* of the apparatus main body 101, and the opening and closing door D is opened and stopped at the predetermined opening angle, is defined as an initial state. As described above, the front cover part 111 is twisted to be inclined at the angle g with respect to the virtual line 113 parallel to the rotation shaft 111*r*. As a result, a relationship between a distance Sa in which the engaged portion 105*a* of the front cover part 111 moves to engage with the engaging portion 106*a* through the engaging portion 106*a* and a distance Sb in which the engaged portion 105*b* of the front cover part 111 moves to engage with the engaging portion 106*b* through the engaging portion 106*b* is set as Sa<Sb. Further, after the engaged portions 105*a* and 105*b* engage through the engaging portions 106*a* and 106*b*, the engaged portions 105*a* and 105*b* are also further movable to the apparatus main body 101 side as long as backlash distances Pa and Pb (Pa=Pb). The backlash distances Pa and Pb are provided with predetermined distances by considering tolerances in a positional relationship between the engaged portions 105*a* and 105*b* and the engaging portions 106*a* and 106*b* or tolerances in a positional relationship between the opening and closing door D and the apparatus main body 101. In the present exemplary embodiment, even after the engaged portions 105*a* and 105*b* and the engaging portions 106*a* and 106*b* engage with each other, the front cover part 111 is further movable until the front cover part 111 contacts contact portions 107*a* and 107*b* provided at the engaging portions 106*a* and 106*b*. The distances Pa and Pb are determined by the further moved distance.

Further, when the engaging portions 106*a* and 106*b* are pressed by a spring (not illustrated) and the engaged portions 105*a* and 105*b* engage with the engaging portions 106*a* and 106*b* on the engaging portions 106*a* and 106*b*, reaction force (Fa and Fb to be described below) acts on the front cover part 111.

A pressed member 120 (see FIG. 5A) for opening and closing a laser shutter 43 (see FIG. 17) for shielding the laser light emitted by the laser scanner 42 or turning on/off electrification to an interlock switch (not illustrated) is provided in the apparatus main body 101. The pressed member 120 is pressed in a direction to contact the opening and closing door D by an elastic member 121, which is a spring. In addition, when the opening and closing door D is closed at the predetermined opening angle or less, the left part of the opening and closing door D contacts and presses the pressed member 120. As a result, when the opening and closing door D is closed and while the opening and closing door D is closed, reaction force Fs (see FIG. 5B) from the pressed member 120 acts on the left part of the front cover part 111. The pressed member 120 and the elastic member 121 are urging units that apply urging force (reaction force Fs) to the opening and closing door D, at the time of closing the opening and closing door D. As such, in reaction force (urging force with which the urging unit urges the opening and closing door in a direction opposite to a direction to close the opening and closing door D) applied to the opening and closing door D from the apparatus main body 101 side until closing the opening and closing door D, the left part of the opening and closing door D is larger than the right part of the opening and closing door D. Further, when the opening and closing door D is closed, the opening and closing door D presses the pressed member 120 against the urging force of the elastic member 121 and moves the pressed member 120 to a predetermined position, and as a result, the laser shutter 43 is opened to irradiate the laser light to the photosensitive drum 27, turn on the electrification to the interlock switch, and the image forming operation may be performed. In addition, the device which is operated by the pressed member 120 is not limited to only the laser shutter 43 or the interlock switch. For example, when the opening and closing door D is closed, the pressed member 120 is pressed up to a predetermined position to open a fixing shutter 36 (see FIG. 17) that prevents the user from contacting the fixing unit 35 (see FIG. 17) from the closed state or switch a fixing nip from an unpressed state to a pressed state.

As such, when the reaction force applied to the opening and closing door D at the time of closing the opening and closing door D is larger at one end side than at the other end side in the direction of the rotation shaft 111*r*, the 'one-sided closing' may easily occur.

Figure 5B:
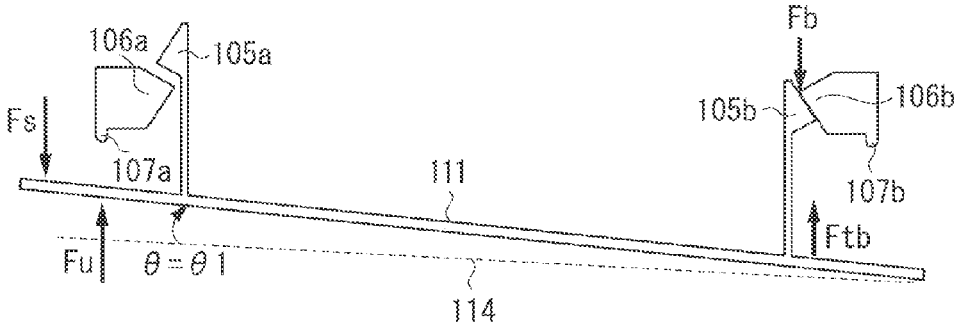
FIG. 5B is a cross-sectional view illustrating the front cover part of the opening and closing door and a part of the apparatus main body around the opening and closing door, which is viewed from the top side of the front cover part.
Figure 5C:
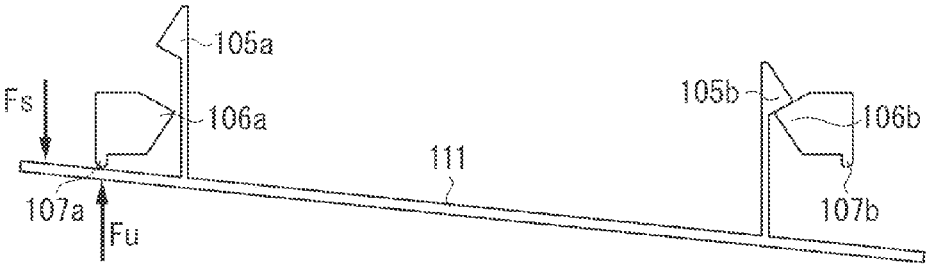
FIG. 5C is a cross-sectional view illustrating the front cover part of the opening and closing door and a part of the apparatus main body around the opening and closing door, which is viewed from the top side of the front cover part.

Subsequently, a case in which the user intends to close the opening and closing door D by pressing only the left part of the front cover part 111 will be described. FIGS. 5B and 5C illustrates the case in which the user presses the left part of the front cover part 111 of the opening and closing door D.

When the user presses the left part of the front cover part 111 with force Fu, the engaged portion 105*a* first engages with the engaging portion 106*a* through the engaging portion 106*a* over the reaction force Fs, as illustrated in FIG. 5B. At this timing, the engaged portion 105*b* receives reaction force Fb from the engaging portion 106*b* not to engage with the engaging portion 106*b*. From this state, further, a bending angle θ from a line 114 indicating an initial twisted state of the front cover part 111 is increased by pressing in the front cover part 111, and the bending angle θ from the initial state becomes θ1. In this state, in the pressing force Fu of the user, force Ftb transferred to the right part of the front cover part 111 from the left part of the front cover part 111 through the front cover part 111 is equivalent to the reaction force Fb. Therefore, by further pressing in the front cover part 111 to contact the contact portion 107*a*, the engaged portion 105*b* engages with the engaging portion 106*b* through the engaging portion 106*b* as illustrated in FIG. 5C.

Figure 6:
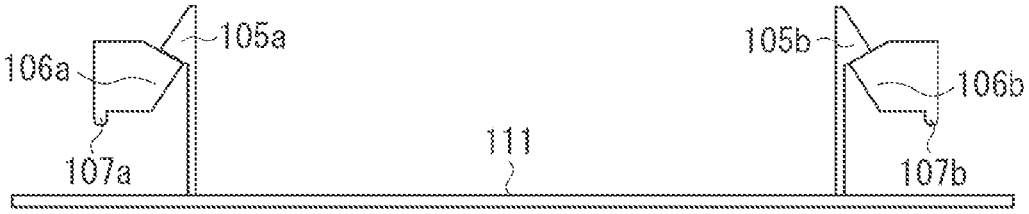
FIG. 6 is a cross-sectional view illustrating the front cover part of the opening and closing door and a part of the apparatus main body around the opening and closing door, which is viewed from the top side of the front cover part.

When the user stops pressing of the opening and closing door D, the opening and closing door D returns to a position where the engaged portions 105*a* and 105*b* contact the engaging portions 106*a* and 106*b* by action of the reaction force Fs or a self-weight, and the opening and closing door D is held in the closed state, as illustrated in FIG. 6. In this case, since the engaged portions 105*a* and 105*b* are pressed by the engaging portions 106*a* and 106*b* to engage with the engaging portions 106*a* and 106*b* by the action of the reaction force Fs, or the like, the initial twisting of the front cover part 111 is substantially recovered.

Further, as illustrated in FIG. 5C, the engaging portion 106*b* hurdles the engaged portion 105*b* and further, backlash-intrudes into a back plane side of the apparatus, but this state is also regarded as a state where the engaging portion 106*b* and the engaged portion 105*b* engage with each other. The reason is that since the engaging portion 106*b* already hurdles the engaged portion 105*b*, the engaging portion 106*b* and the engaged portion 105*b* contact each other to engage with each other when the user stops pressing of the opening and closing door D as described above.

Figure 7A:
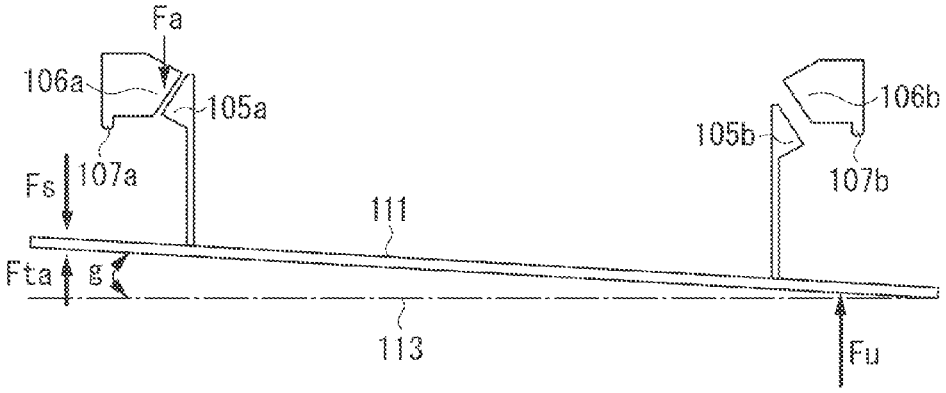
FIG. 7A is a cross-sectional view illustrating the front cover part of the opening and closing door and a part of the apparatus main body around the opening and closing door, which is viewed from the top side of the front cover part.
Figure 7B:
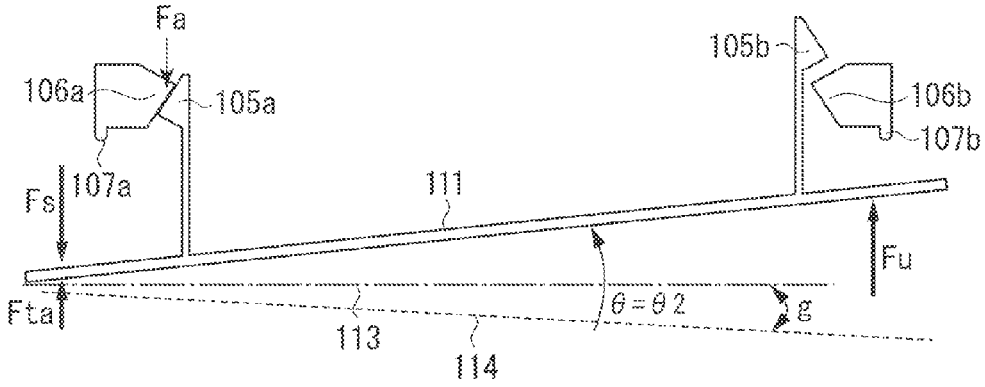
FIG. 7B is a cross-sectional view illustrating the front cover part of the opening and closing door and a part of the apparatus main body around the opening and closing door, which is viewed from the top side of the front cover part.
Figure 7C:
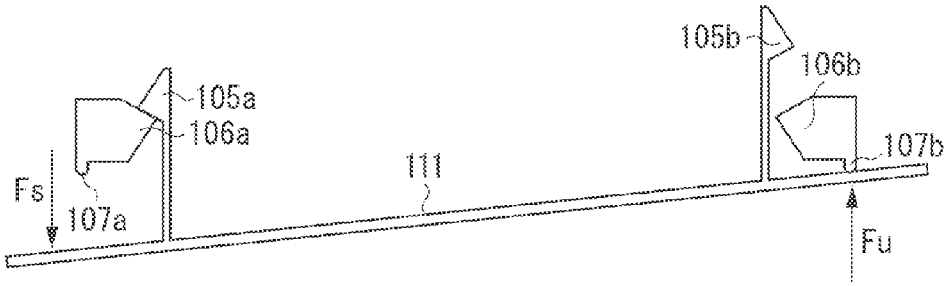
FIG. 7C is a cross-sectional view illustrating the front cover part of the opening and closing door and a part of the apparatus main body around the opening and closing door, which is viewed from the top side of the front cover part.

Subsequently, a case in which the user intends to close the opening and closing door D by pressing only the right part of the front cover part 111 will be described. FIGS. 7A and 7C illustrate the case in which the user pressurizes the right part of the front cover part 111 of the opening and closing door D.

When the user presses the right part of the front cover part with the force Fu, the left engaged portion 105*a* first contacts the engaging portion 106*a*, as illustrated in FIG. 7A. The reason is that the front cover part 111 is twisted at the angle g with respect to the virtual line 113. In this state, the twisting angle θ of the front cover part 111 from the initial twisted state is 0. As a result, in the pressing force Fu of the user, force Fta transferred to the left part of the front cover part 111 from the right part of the front cover part 111 through the front cover part 111 may not be larger than sum of the reaction force Fs and the reaction force Fa. As a result, the engaged portion 105*a* may not engage with the engaging portion 106*a* on the engaging portion 106*a*.

Further, when the user presses the right part of the front cover part 111, the engaged portion 105*b* engages with the engaging portion 106*b* on the engaging portion 106*b*. Further, as the user presses the right part of the front cover part 111, the bending angle θ of the front cover part 111 from the initial twisted state is increased. With this, in the pressing force Fu of the user, the force Fta transferred to the left part of the front cover part 111 from the right part of the front cover part 111 through the front cover part 111 is also gradually increased. As illustrated in FIG. 7B, while the bending angle θ from the initial twisted state is θ2, the force Fta is equivalent to the sum force of the reaction force Fs and the reaction force Fa. As a result, as illustrated in FIG. 7C, while the user further presses the right part of the front cover part 111 until contacting the contact portion 107*b*, the engaged portion 105*a* engages with the engaging portion 106*a* on the engaging portion 106*a*. When the user stops pressing the opening and closing door D, the opening and closing door D returns to a position where the engaged portions 105*a* and 105*b* contact the engaging portions 106*a* and 106*b*, and as a result, the opening and closing door D is held in the closed state, as illustrated in FIG. 6.

Further, as illustrated by comparing FIGS. 5A and 6, when the opening and closing door D is viewed in a direction parallel to an exterior surface of the front cover part 111 and perpendicular to the rotation shaft 111*r*, the opened state (FIG. 5A) of the opening and closing door D and the closed state (FIG. 6) of the opening and closing door D are different in angle of the exterior surface of the opening and closing door D.

Figure 16A:
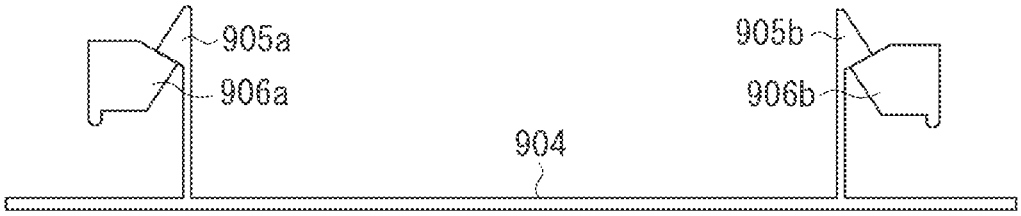
FIG. 16A is a cross-sectional view illustrating an opening and closing door and a part of an apparatus main body around the opening and closing door in the related art, which is viewed from the top side of the opening and closing door.
Figure 16B:
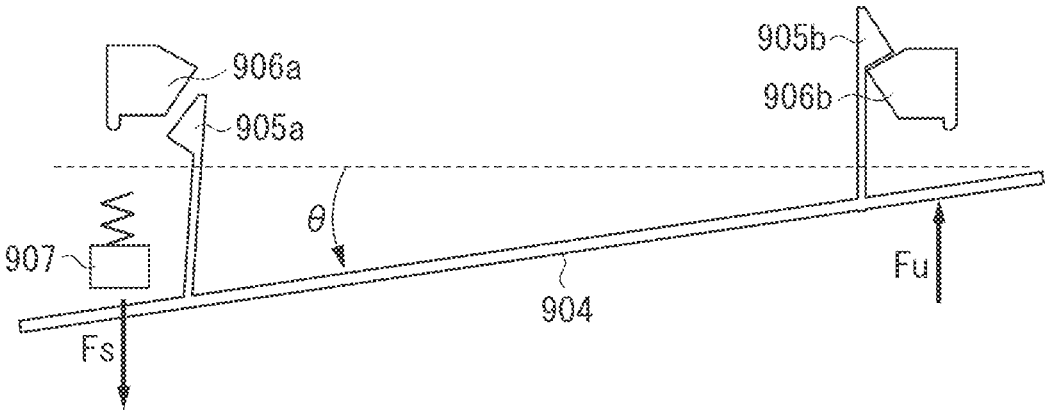
FIG. 16B is a cross-sectional view illustrating the opening and closing door and a part of the apparatus main body around the opening and closing door in the related art, which is viewed from the top side of the opening and closing door.

In the configuration in the related art illustrated in FIG. 16B, even though the user presses the opening and closing door 904 to the end until the opening and closing door 904 contacts the apparatus main body, the bending angle θ to the initial state of the opening and closing door 904 may not be set to be a large value. As a result, in the pressure Fu of the user, force transferred to the left part of the opening and closing door 904 from the right part of the opening and closing door 904 via the opening and closing door 904 may not be more than the reaction force Fs and the engaged portion 905*a* may not engage with the engaging portion 906*a*, and the one-sided closing state occurs.

In this regard, in the present exemplary embodiment, the front cover part 111 is twisted at the angle g with respect to the virtual line 113 from the initial state. As a result, the bending angle θ of the front cover part 111 from the initial state may be larger than that in the configuration in the related art while the user presses the right part of the front cover part 111 with the force Fu. Therefore, the front cover part 111 may be bent until the bending angle θ at which the force Fta transferred to the left part of the front cover part 111 from the right part of the front cover part 111 via the front cover part 111 in the pressing force Fu of the user is more than the sum force (Fs+Fa) of the reaction forces is θ2. Further, in the present exemplary embodiment, after the engaged portion 105*b* engages with the engaging portion 106*b* on the engaging portion 106*b*, the engaged portion 105*a* engages with the engaging portion 106*a* on the engaging portion 106*a* while the user further presses the right part of the front cover part 111 until contacting the contact portion 107*b*. However, the present invention is not limited thereto. That is, before the engaged portion 105*b* engages with the engaging portion 106*b* on the engaging portion 106*b*, the engaged portion 105*a* may engage with the engaging portion 106*a* on the engaging portion 106*a*.

However, when the initial twisting angle g of the front cover part 111 is too large, the one-sided closing occurs only if the user presses only a part (left part) where the reaction force is large. Therefore, the initial twisting angle g may be set to satisfy the following condition.

When the opening and closing door D is closed, reaction force applied to the left part of the front cover part 111 is set as Fl and reaction force applied to the right part is set as Fr. A bending angle from the initial state in which the left part of the front cover part 111 is close to the main body of the apparatus is set as θ1 (the direction of the arrow is positive), as illustrated in FIG. 5B. and a bending angle from the initial state in which the right part of the front cover part 111 is close to the apparatus main body is set as θ2 (the direction of the arrow is positive), as illustrated in FIG. 7B.

Further, while the front cover part 111 is bent at the bending angle θ from the initial state, transfer force transferred to the other part of the front cover part 111 via the front cover part 111 in force to press one part of the front cover part 111 in a closing direction is set as Ft(θ). For example, when the force is transferred to the left part from the right part, the transfer force is represented by Ft(θ, L). Further, the transfer force Ft depends on a bending amount from the initial state and the transfer force is determined by a variation even though a bending direction is a positive direction of θ1 or a positive direction of θ2.

In this case, when only the left part is pressed in the closing direction, a condition in which the one-sided closing does not occur may be represented by $$Fr<Ft(\theta 1,R) \quad (1).$$

When only the right part is pressed in the closing direction, the condition in which the one-sided closing does not occur may be represented by $$Fl<Ft(\theta 2,L) \quad (2).$$

Therefore, the twisting angle g of the initial state is set to acquire θ1 and θ2 that satisfy Equations (1) and (2).

Further, as described in the present exemplary embodiment, when Fl and Fr are different from each other, for example, if Fl>Fr, a relationship of minimum required transfer force Ft is $$Ft(\theta 2,L)>Ft(\theta 1,R) \quad (3).$$

In addition, the larger the transfer force Ft is, the larger the bending angle θ is, and as a result, the relationship between θ1 and θ2 is $$\theta 2>\theta 1 \quad (4).$$

As described above, in the present exemplary embodiment, in a configuration in which reaction forces received at the time of closing the front cover part 111 are different from each other at the left part and the right part, the front cover part 111 is twisted in advance so that the left part having the larger reaction force is closer to the apparatus main body 101 than the right part having the smaller reaction force while the opening and closing door D is opened. By this configuration, as illustrated in FIG. 5A, the opening and closing door D is closed from a predetermined opened position (initial state) of the opening and closing door D (front cover part 111), and as a result, the distances Sa and Sb until the engaged portions 105*a* and 105*b* engage with the engaging portions 106*a* and 106*b* are the shorter at the left part having the larger reaction force and the longer at the right part having the smaller reaction force (that is, Sa<Sb). As a result, even if the user presses only the part (right part) having smaller reaction force where the one-sided closing easily occurs, the bending angle θ at which the front cover part 111 is bent by receiving the reaction force may be larger at the time of closing the opening and closing door D with respect to the initial state of the front cover part 111. Therefore, the engaged portion 105*a* may engage with the engaging portion 106*a* and the one-sided closing may be prevented.

Further, in the present exemplary embodiment, an arrangement direction of the engaging portions 106*a* and 106*b* is parallel to the direction of the rotation shaft 111*r*. As a result, in the initial state in which the opening and closing door D (front cover part 111) is opened, the engaged portion 105*a* at the part having larger reaction force is positioned more downstream of the engaged portion 105*b* having smaller reaction force in a movement direction (a direction of the force Fu of the user) of the opening and closing door D at the time of closing the opening and closing door D. By this configuration, the distances Sa and Sb until the engaged portions 105*a* and 105*b* engage with the engaging portions 106*a* and 106*b* may be shorter at the left part having larger reaction force and longer at the right part having smaller reaction force.

Further, in the present exemplary embodiment, the opening and closing door D is constituted by two components of the front cover part 111 and the upper cover part 110, and the front cover part 111 is fixed to the upper cover part 110 with the front cover part 111 being twisted, and as a result, the distances Sa and Sb until the left and right engaged portions engage with the engaging portions corresponding thereto are different from each other. However, a method of making the distances Sa and Sb different is not limited to this method. That is, by molding, and the like, when a component having the same shape as the twisted shape is used for the front cover part 111 in advance, the opening and closing door D may be assembled without twisting the front cover part 111.

Further, the engaged portions 105*a* and 105*b* are provided integrally with the front cover part 111, but the engaged portions 105 and 105*b* may be provided in the upper cover part 110.

Further, the distances Sa and Sb may be different from each other even by making protruding lengths of the engaged portions 105*a* and 105*b* that protrude from the front cover part 111 different and/or displacing the positions of the engaging portions 106*a* and 106*b* in an opening and closing direction of the opening and closing door D. This configuration will be described in detail in a second exemplary embodiment.

Further, as other forms, even though the distance Sa is equal to the distance Sb, when the left and right backlash distances Pa and Pb at the apparatus main body 101 side are configured to be different from each other, the same effect as the present exemplary embodiment may be acquired. That is, the backlash distance Pa at the part having larger reaction force is configured to be shorter than the backlash distance Pb at the part having smaller reaction force.

As such, in the present exemplary embodiment, in the case of a distance (Sa+Pa) and a distance (Sb+Pb), the distance in the part having the larger reaction force is configured to be shorter than the distance in the part having the smaller reaction force to thereby prevent the one-sided closing at the time of pressing only the part having the smaller reaction force.

However, when the backlash distances Pa and Pb are increased, rattling of the opening and closing door D becomes larger while the opening and closing door D is closed. As a result, the backlash distances Pa and Pb themselves may not be so large. Therefore, the one-sided closing may be prevented without increasing the rattling of the opening and closing door D while the opening and closing door D is closed by making the distances Sa and Sb different as compared with by making the backlash distances Pa and Pb different.

As such, according to the present exemplary embodiment, when the user closes the opening and closing door D even by pressing only one side of the opening and closing door D, the one-sided closing state may be prevented and usability at the time of closing the opening and closing door may be excellent.

Subsequently, a second embodiment will be described. A configuration will be described, in which a line that connects apexes of the engaging portions 106*a* and 106*b* is parallel to the virtual line 113 as illustrated in FIG. 5A in the first exemplary embodiment, while the line is not parallel to the virtual line 113 in the second exemplary embodiment. Other configurations are the same as those of the first exemplary embodiment, and the same reference numerals refer to the same components and a description thereof will be omitted. FIGS. 8A to 8C, FIG. 9, and FIGS. 10A and 10B are cross-sectional views illustrating a front cover part 211 of the opening/closing door D and a part of the apparatus main body 101 around the opening and closing door D, which is viewed from the top side of the front cover part 211. In the present exemplary embodiment, a line 217 that connects apexes of engaging portions 206*a* and 206*b* is inclined to a virtual line 213 parallel to the rotation shaft 111*r*.

Figure 8A:
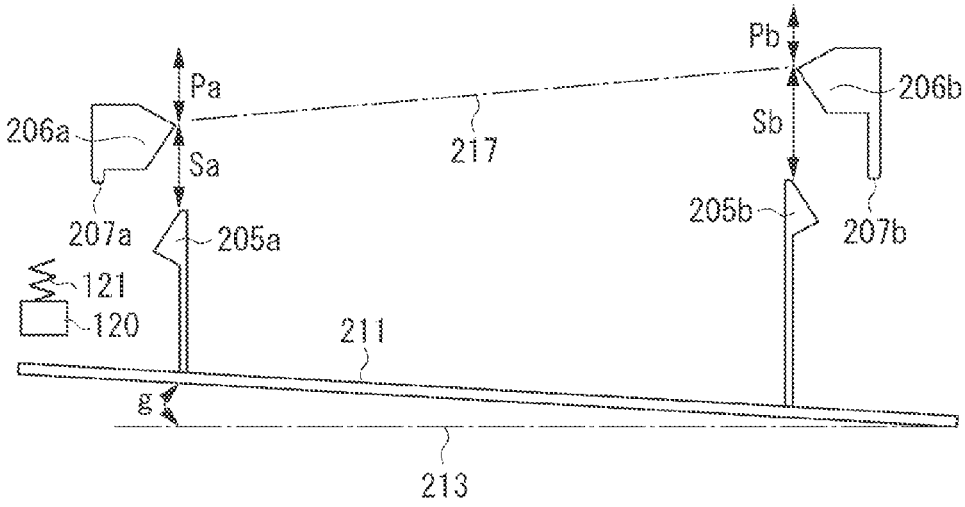
FIG. 8A is a cross-sectional view illustrating the front cover part of the opening and closing door and a part of the apparatus main body around the opening and closing door, which is viewed from the top side of the front cover part.

FIG. 8A illustrates a state in which the opening/closing door D is opened and stopped at a predetermined opening angle. That is, FIG. 8A illustrates a state in which the engaged portions 205*a* and 205*b* of the front cover part 211 do not engage with the engaging portions 206*a* and 206*b* of the apparatus main body 101. As described above, the front cover part 211 is twisted to be inclined at the angle g with respect to the virtual line 113 parallel to the rotation shaft 211*r*. As a result, a relationship between a distance Sa moving until the engaged portion 205*a* of the front cover part 211 engage with the engaging portion 206*a* through the engaging portion 206*a* and a distance Sb moving until the engaged portion 205*b* of the front cover part 211 moves to engage with the engaging portion 206*b* through the engaging portion 206*b* is set as Sa<Sb. Further, after the engaged portions 205*a* and 205*b* engage with the engaging portions 206*a* and 206*b* through the engaging portions 206*a* and 206*b*, the engaged portions 205*a* and 205*b* are also further movable to the apparatus main body 101 side as long as backlash distances Pa and Pb (Pa=Pb). The backlash distances Pa and Pb are provided with predetermined distances by considering tolerances of a positional relationship between the engaged portions 205*a* and 205*b* and the engaging portions 206*a* and 206*b* or tolerances of a positional relationship between the opening and closing door D and the apparatus main body 101. In the present exemplary embodiment, even after the engaged portions 205*a* and 205*b* and the engaging portions 206*a* and 206*b* engage with each other, the front cover part 211 is further movable until the front cover part 211 contacts contact portions 207*a* and 207*b* provided at the engaging portions 206*a* and 206*b*. The distances Pa and Pb are determined by the further moved distance.

Further, when the engaging portions 206*a* and 106*b* are pressed by a spring (not illustrated), and the engaged portions 205*a* and 205*b* engage with the engaging portions 206*a* and 206*b* on the engaging portions 206*a* and 206*b*, reaction force (Fa and Fb to be described below) acts on the front cover part 211. In addition, it is configured in such a manner that a left part of the opening and closing door D presses a member in the apparatus main body 101 for opening and closing the laser shutter (not illustrated) provided in the laser scanner 42 or turning on/off electrification to the interlock (not illustrated). As a result, when the opening and closing door D is closed and while the opening and closing door D is closed, the reaction force Fs (see FIG. 8B) acts on the left part of the front cover part 211. Therefore, the reaction force applied to the opening and closing door D from the apparatus main body 101 side is larger in the left part than in the right part until closing the opening and closing door D.

Figure 8B:
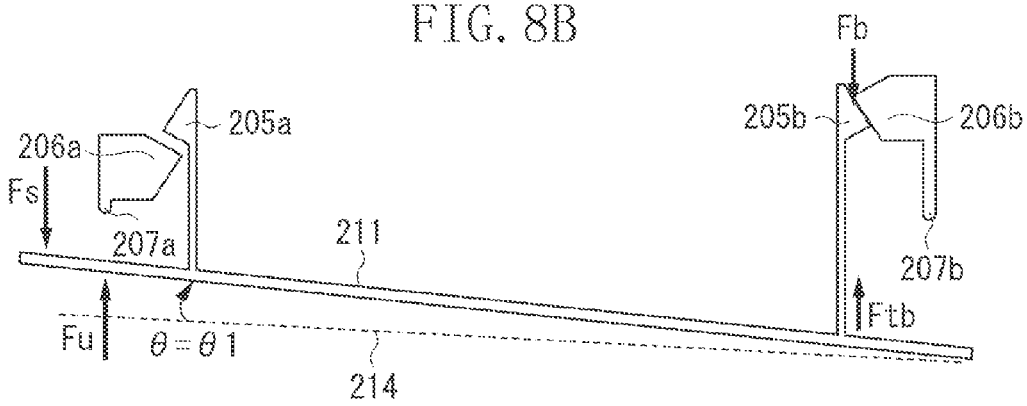
FIG. 8B is a cross-sectional view illustrating the front cover part of the opening and closing door and a part of the apparatus main body around the opening and closing door, which is viewed from the top side of the front cover part.
Figure 8C:
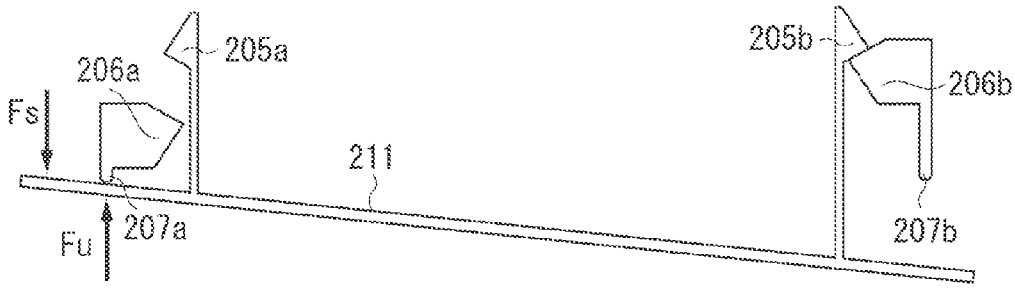
FIG. 8C is a cross-sectional view illustrating the front cover part of the opening and closing door and a part of the apparatus main body around the opening and closing door, which is viewed from the top side of the front cover part.

Subsequently, a case in which the user intends to close the opening and closing door D by pressing the left part of the front cover part 211 will be described. FIGS. 8B and 8C illustrate the case in which the user presses the left part of the front cover part 211 of the opening and closing door D.

When the user presses the left part of the front cover part 211 with the force Fu, as illustrated in FIG. 8B, the engaged portion 205*a* first engages with the engaging portion 206*a* through the engaging portion 206*a* over the reaction force Fs. At this timing, the engaged portion 205*b* receives the reaction force Fb from the engaging portion 206*b* not to engage with the engaging portion 206*b*. From this state, further, the bending angle θ from a line 214 indicating an initial twisted state of the front cover part 211 is increased by pressing the front cover part 211, and the bending angle θ from the initial state becomes θ1. In this state, in the pressing force Fu of the user, force Ftb transferred to the right part of the front cover part 211 from the left part of the front cover part 211 via the front cover part 211 is equivalent to the reaction force Fb. Therefore, by further pressing in the front cover part 211, which contacts the contact portion 207*a*, the engaged portion 205*b* engages with the engaging portion 206*b* through the engaging portion 206*b*, as illustrated in FIG. 8C.

Figure 9:
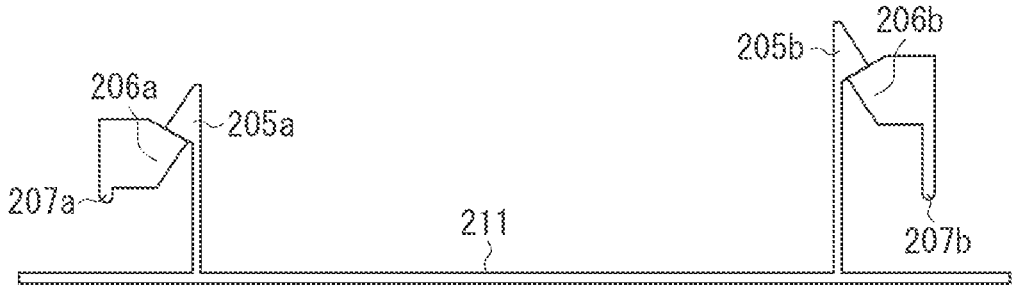
FIG. 9 is a cross-sectional view illustrating the front cover part of the opening and closing door and a part of the apparatus main body around the opening and closing door, which is viewed from the top side of the front cover part.

When the user stops pressing the opening and closing door D, the opening and closing door D returns to a position where the engaged portions 205*a* and 205*b* contact the engaging portions 206*a* and 206*b* by action of the reaction force Fs, or the like, and the opening and closing door D is held in the closed state, as illustrated in FIG. 9. In this case, since the engaged portions 205*a* and 205*b* are pressed by the engaging portions 206*a* and 206*b* by the action of the reaction force Fs, or the like, the initial twisting of the front cover part 211 is substantially recovered.

Figure 10A:
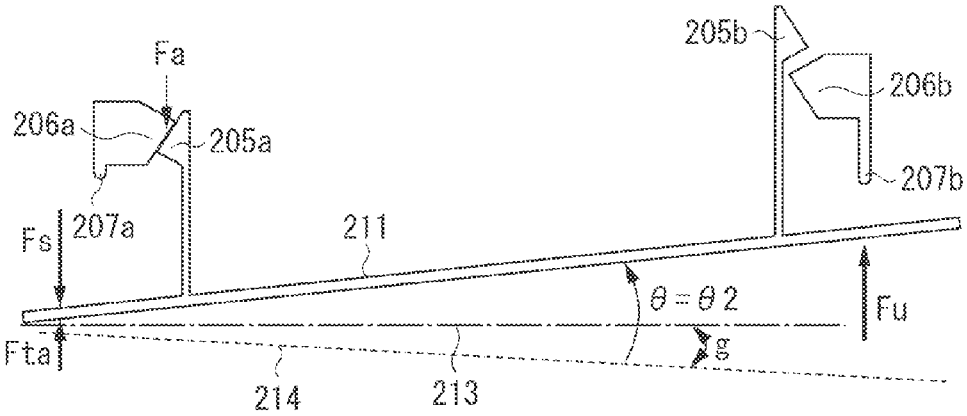
FIG. 10A is a cross-sectional view illustrating the front cover part of the opening and closing door and a part of the apparatus main body around the opening and closing door, which is viewed from the top side of the front cover part.
Figure 10B:
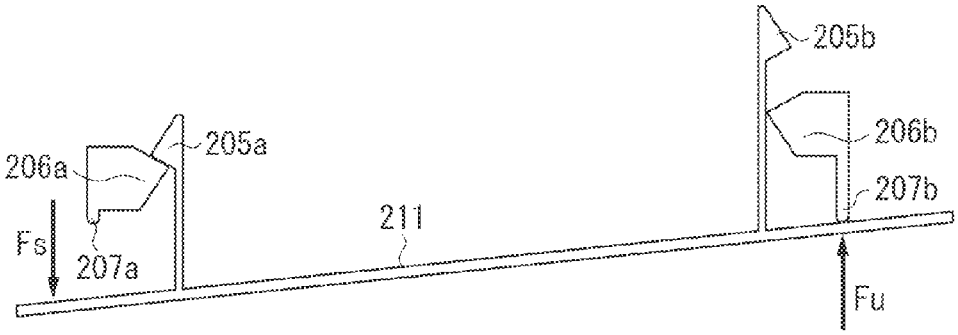
FIG. 10B is a cross-sectional view illustrating the front cover part of the opening and closing door and a part of the apparatus main body around the opening and closing door, which is viewed from the top side of the front cover part.

Subsequently, a case in which the user intends to close the opening and closing door D by pressing the right part of the front cover part 211 will be described. FIGS. 10A and 10B illustrate the case in which the user presses the right part of the front cover part 211 of the opening and closing door D.

When the user presses the right part of the front cover part with the force Fu, the left engaged portion 205*a* first contacts the engaging portion 206*a*. The reason is that the front cover part 211 is twisted at the angle g with respect to the virtual line 113. In this state, the twisting angle θ of the front cover part 211 from the initial twisted state is 0. As a result, in the pressing force Fu of the user, force Fta transferred to the left part of the front cover part 211 from the right part of the front cover part 211 via the front cover part 211 may not be larger than sum force of the reaction force Fs and the reaction force Fa. As a result, the engaged portion 205*a* may not engage with the engaging portion 206*a* on the engaging portion 206*a*.

Further, when the user presses the right part of the front cover part 211, the engaged portion 205*b* engages with the engaging portion 206*b* on the engaging portion 206*b*, as illustrated in FIG. 10A. Further, as the user presses the right part of the front cover part 211, the bending angle θ of the front cover part 211 from the initial twisted state is increased. As a result, in the pressing force Fu of the user, the force Fta transferred to the left part of the front cover part 211 from the right part of the front cover part 211 via the front cover part 211 is also gradually increased. As illustrated in FIG. 10A, while the bending angle θ from the initial twisted state is θ2, the force Fta is equivalent to the sum force of the reaction force Fs and the reaction force Fa. As a result, as illustrated in FIG. 10B, while the user further presses the right part of the front cover part 211 until the right part of the front cover part 211 contacts the contact portion 207*b*, the engaged portion 205*a* engages with the engaging portion 206*a* on the engaging portion 206*a*. When the user stops pressing the opening and closing door D, the opening and closing door D returns to a position where the engaged portions 205*a* and 205*b* contact the engaging portions 206*a* and 206*b*, and as a result, the opening and closing door D is held in the closed state, as illustrated in FIG. 9.

As described above, in the present exemplary embodiment, in a configuration in which reaction forces received at the time of closing the front cover part 211 are different from each other at the left part and the right part, the front cover part 211 is twisted in advance so that the left part having larger reaction force is closer to the apparatus main body 101 than the right part having smaller reaction force while the opening and closing door D is opened. By this configuration, similarly to the first exemplary embodiment, the distances Sa and Sb until the engaged portions 205*a* and 205*b* engage with the engaging portions 206*a* and 206*b* may be shorter at the left part having larger reaction force and longer at the right part having smaller reaction force (that is, Sa<Sb). As a result, even if the user presses only the part (right part) having smaller reaction force where the one-sided closing easily occurs, the bending angle θ with respect to the initial state of the front cover part 211 may be larger, and as a result, the engaged portion 205*a* may engage with the engaging portion 206*a*.

As such, according to the present exemplary embodiment, when the user closes the opening and closing door D even by pressing only one side of the opening and closing door D, the one-sided closing state may be prevented and usability at the time of closing the opening and closing door may be excellent.

Subsequently, a third exemplary embodiment will be described. In the present exemplary embodiment, a configuration in which the positions of the upper cover part and the front cover part described in the first exemplary embodiment are changed will be described. Since other configurations are the same as those of the first exemplary embodiment, a description thereof will be omitted.

Figure 11:
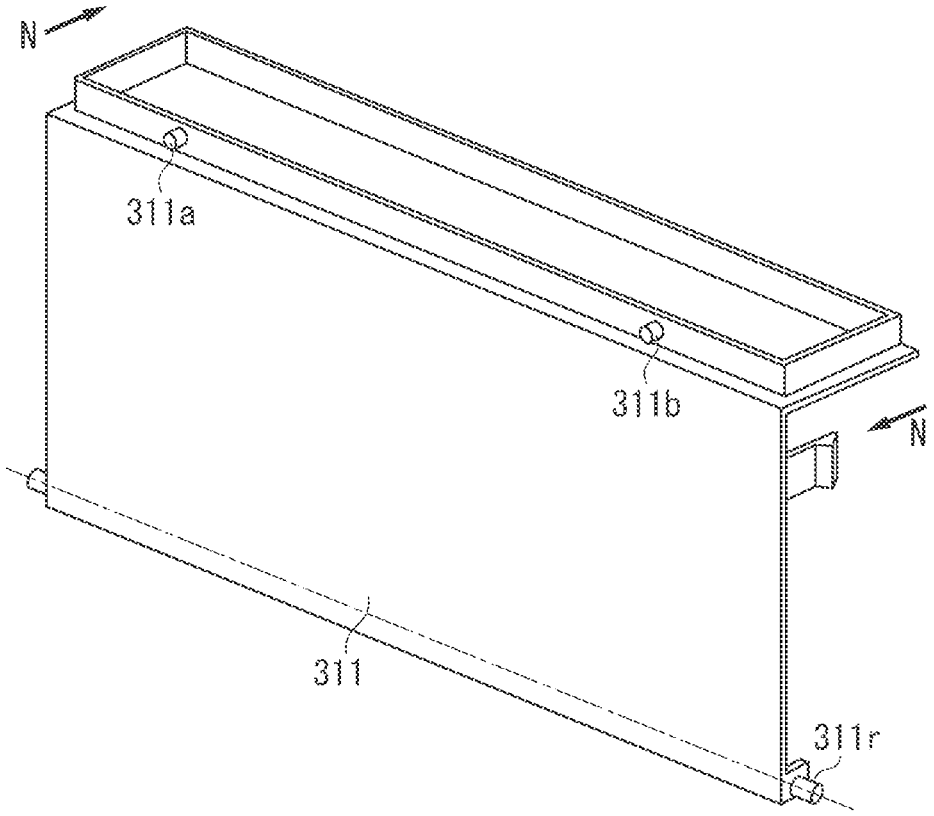
FIG. 11 is a perspective view of the front cover part.
Figure 12A:
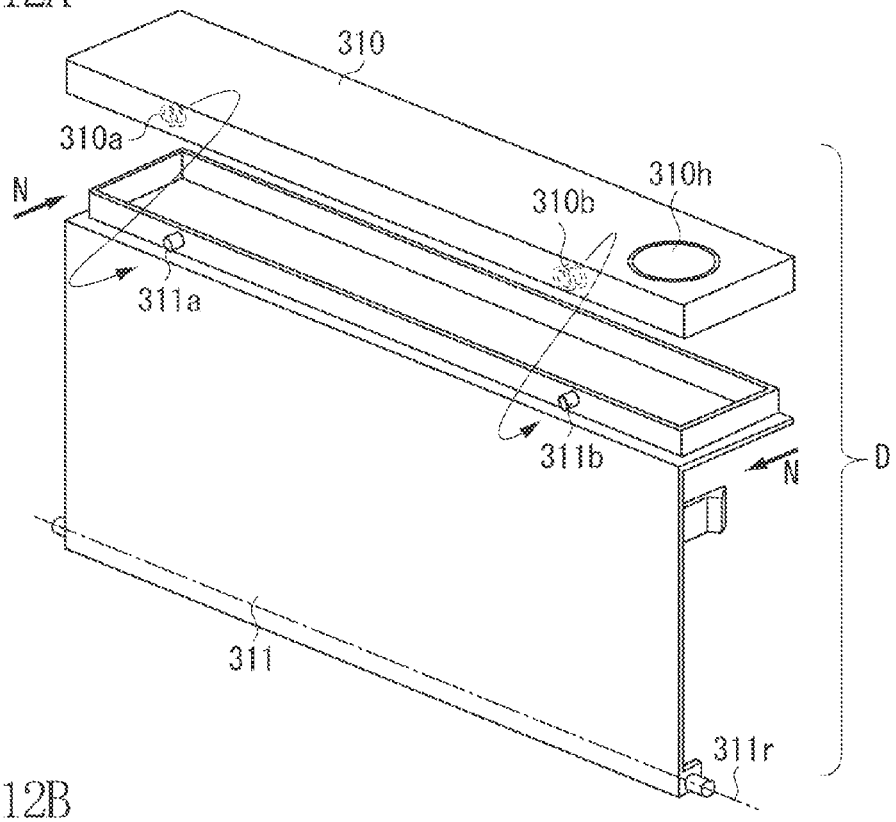
FIG. 12A is a perspective view illustrating a state before the upper cover part and the front cover part are combined with each other.
Figure 12B:
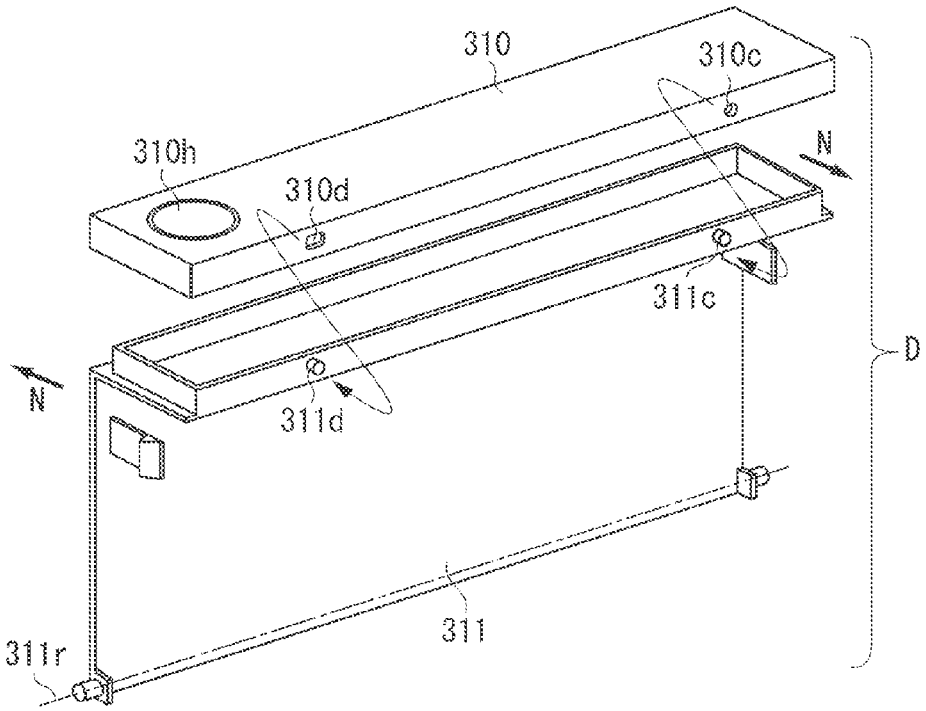
FIG. 12B is a perspective view illustrating the state before the upper cover part and the front cover part are combined with each other.

Subsequently, a method of assembling the opening and closing door D in which a front cover part 311 is twisted will be described with reference to FIGS. 11 to 14. FIG. 11 is a perspective view viewed from a front side of the front cover part 311, and FIGS. 12A and 12B are perspective views illustrating a state before an upper cover part 310 and the front cover part 311 are combined with each other. FIG. 12A is a diagram viewed from the front side and FIG. 12B is a diagram viewed from a back side. Bosses 311*a*, 311*b*, 311*c*, and 311*d* of the front cover part 311 fit in holes 310*a*, 310*b*, 310*c*, and 310*d* of the upper cover part 310 to combine the upper cover part 310 and the front cover part 311 with each other. Further, the hole 310*d* is a long hole in which the rotation shaft extends in a longitudinal direction of the upper cover part 310. In the present invention, before combining the upper cover part 310 and the front cover part 311 with each other, the front cover part 311 is twisted by pressing the left and right parts of the front cover part 311 in the direction of the arrow N of FIG. 11. In addition, the upper cover part 310 is mounted in the twisted state, and as a result, the front cover part 311 is kept being twisted by the fit-in of the bosses 311*a*, 311*b*, 311*c*, and 311*d* and the holes 310*a*, 310*b*, 310*c*, and 310*d*. The reason is that the front cover part 311 and the upper cover part 310 are configured so that the upper cover part 310 is higher in rigidity than the front cover part 311 with respect to the arrow N direction twisting while the opening and closing door D is opened.

Figure 13A:
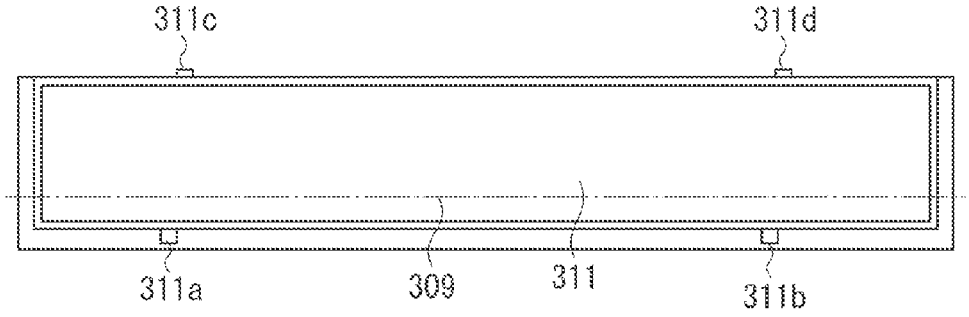
FIG. 13A is a top view of the front cover part.
Figure 13B:
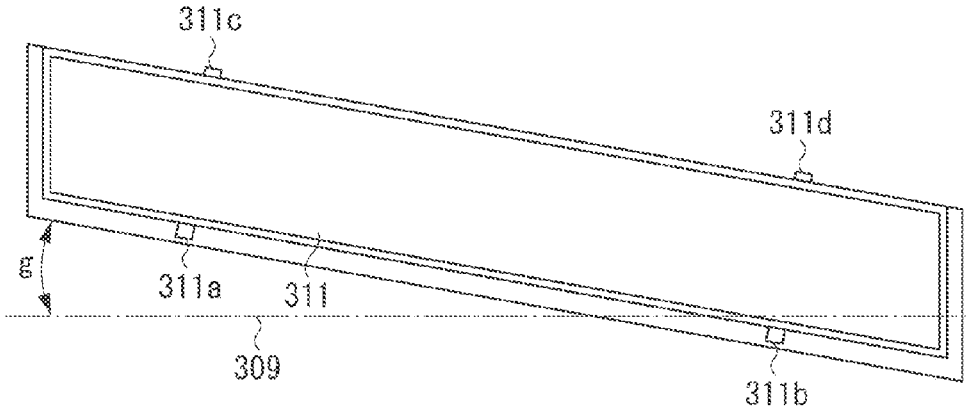
FIG. 13B is a top view of the front cover part.
Figure 14:
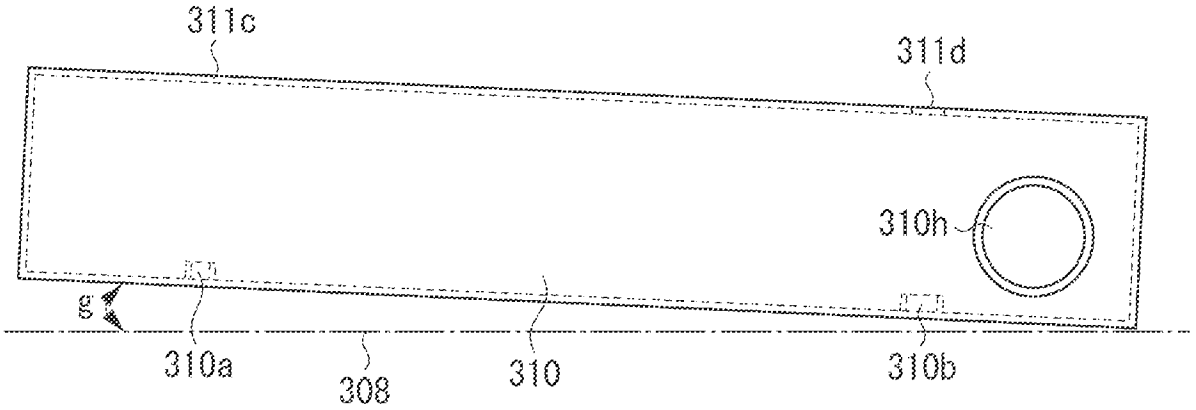
FIG. 14 is a top view of the upper cover part.
Figure 15:
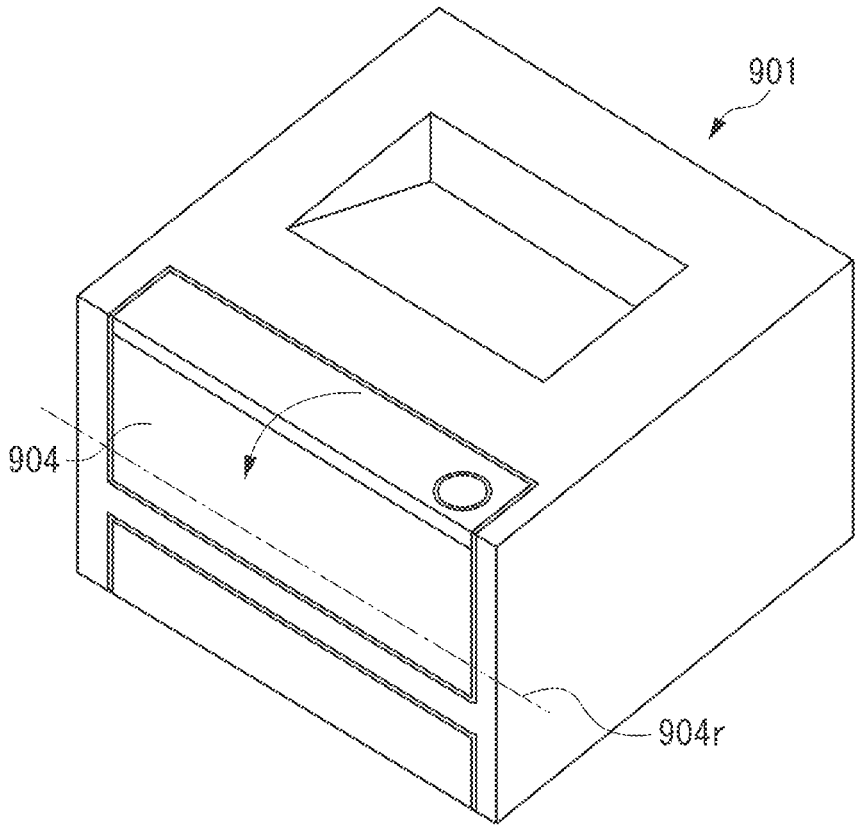
FIG. 15 is a perspective view of an image forming apparatus in the related art.

The reason will be described in more detail. FIGS. 13A and 13B are top views of the front cover part 311, and FIG. 13A illustrates a state before the front cover part 311 is twisted and FIG. 13B illustrates a twisted state of the front cover part 311. FIG. 14 is a top view of the upper cover part 310. Further, in FIG. 13B, the twisted state is emphasized and drawn for simplification. The front cover part 311 is twisted, and as a result, the top of the front cover part 311 is deformed. That is, when the top before twisting is a rectangle parallel to a virtual line 309 which is parallel to the rotation shaft 311*r*, the top has a shape of a parallelogram which is inclined at an angle g with respect to the virtual line 309 in the twisted state. As a result, the state before twisting and the twisted state are different from each other in relative positional relationship of the bosses 311*a*, 311*b*, and 311*c*. In addition, the relative positional relationship of the holes 310*a*, 310*b*, and 310*c* of the upper cover part 310 is configured to coincide with the relative positional relationship of the bosses 311*a*, 311*b*, and 311*c* of the front cover part 311 in the twisted state. Therefore, the holes 310*a*, 310*b*, and 310*c* of the upper cover part 310 fit in the bosses 311*a*, 311*b*, and 311*c* of the front cover part 311 in the twisted state, and the front cover part 311 is kept being twisted. Further, the holes 310*a*, 310*b*, and 310*c* fit in the bosses 311*a*, 311*b*, and 311*c* while the upper cover part 310 is inclined diagonally at the angle g with respect to a virtual line 309. By the aforementioned configuration, the opening and closing door D may be configured with the front cover part 311 being twisted similarly to the first exemplary embodiment.

As such, according to the present exemplary embodiment, when the user closes the opening and closing door D even by pressing one side of the opening and closing door D, the one-sided closing state may be prevented and usability at the time of closing the opening and closing door may be excellent.

Further, in the first, second, and third exemplary embodiments, it is assumed that the reaction forces received at the time of closing the opening and closing door D are different from each other at left and right sides (both sides in the direction of the rotation shaft of the opening and closing door D). However, a configuration to establish the assumption is not limited to a configuration in which a pressed portion (pressed member 120) is provided at one side with respect to the direction of the rotation shaft of the opening and closing door D. That is, the pressed portion may be provided at each of both sides with respect to the rotation shaft of the opening and closing door D of the apparatus main body, and in this case, both pressed portions receive pressing force from the elastic member such as a spring to open the opening and closing door D and thus force to press both pressed portions in a direction to open the opening and closing door D are just different from each other. By this configuration, the reaction forces received at the time of closing the opening and closing door D are different from each other at both sides in the direction of the rotation shaft of the opening and closing door D, and as a result, the aforementioned assumption is established and the spirit of the first, second and third exemplary embodiments may be applied.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2012-102475 filed Apr. 27, 2012 and No. 2013-077004 filed Apr. 2, 2013, which are hereby incorporated by reference herein in their entirety.

What is claimed is:

1. An image forming apparatus comprising:

an opening and closing member configured to rotate with respect to an apparatus main body to open an inside of the apparatus main body;

a first engaging portion and a second engaging portion provided in the apparatus main body;

a first engaged portion and a second engaged portion provided in the opening and closing member and configured to engage with the first engaging portion and the second engaging portion of the apparatus main body, respectively; and an urging unit configured to urge the opening and closing member in a direction opposite to a direction to close the opening and closing member, wherein the first engaged portion is arranged one side of the opening and closing member in a direction of a rotation shaft of the opening and closing member, and the second engaged portion is arranged the other side of the opening and closing member in a direction of a rotation shaft of the opening and closing member, and when the first engaging portion and the first engaged portion engage with each other and the second engaging portion and the second engaged portion engage with each other, the opening and closing member is held in a closed state, wherein, when the opening and closing member is being closed, urging force which the one side of the opening and closing member receives from the urging unit is larger than the urging force which the other side of the opening and closing member receives from the urging unit, wherein, when the opening and closing member is closed from an opened state of the opening and closing member, the first engaged portion engages the first engaging portion by moving through the first engaging portion and the second engaged portion engages the second engaging portion by moving through the second engaging portion, and wherein a distance which the first engaged portion moves until the first engaged portion engages with the first engaging portion is shorter than a distance which the second engaged portion moves until the second engaged portion engages with the second engaging portion while the first engaged portion and the second engaged portion are caused to engage with the first engaging portion and the second engaging portion, respectively, by closing the opening and closing member from the opened state.

2. The image forming apparatus according to claim 1, wherein, in the opened state of the opening and closing member, the first engaged portion is positioned downstream of the second engaged portion in regard to a movement direction of the opening and closing member when the opening and closing member is being closed.

3. The image forming apparatus according to claim 1, wherein a relative positional relationship between the first engaged portion and the second engaged portion differs between the opened state of the opening and closing member and the closed state of the opening and closing member.

4. The image forming apparatus according to claim 1, wherein an angle of an exterior surface of the opening and closing member differs between the opened state of the opening and closing member and the closed state of the opening and closing member, when viewed in a direction parallel to the exterior surface of the opening and closing member and perpendicular to the rotation shaft.

5. The image forming apparatus according to claim 1, wherein the opening and closing member includes a first member and a second member, the second member holding the first member while twisting the first member around an axis perpendicular to the rotation shaft.

6. The image forming apparatus according to claim 5, wherein the first engaged portion and the second engaged portion are provided in the first member.

7. The image forming apparatus according to claim 1, wherein an arrangement direction of the first engaging portion and the second engaging portion is parallel to the direction of the rotation shaft.

8. The image forming apparatus according to claim 1, wherein the urging unit includes a pressed portion configured to be pressed to the opening and closing member when the opening and closing member is being closed with respect to the apparatus main body, the pressed portion being pressed at the first engaged portion of the opening and closing member.

9. The image forming apparatus according to claim 8, further comprising:

a laser light irradiating unit configured to irradiate laser light to a photosensitive member; and a laser shutter capable of shielding the laser light emitted from the laser light irradiating unit, wherein the pressed portion is pressed to move the laser shutter and to enable the laser light irradiating unit to irradiate the laser light to the photosensitive member.

10. The image forming apparatus according to claim 8, further comprising:

a fixing unit configured to fix a toner image to a recording material; and a fixing shutter configured to be movable to a position to cover the fixing unit, wherein the pressed portion is pressed to move the fixing shutter to the position to cover the fixing unit.

11. An image forming apparatus comprising:

an opening and closing member configured to rotate with respect to an apparatus main body to open an inside of the apparatus main body;

a first engaging portion and a second engaging portion provided in the apparatus main body;

a first engaged portion and a second engaged portion provided in the opening and closing member and configured to engage with the first engaging portion and the second engaging portion of the apparatus main body, respectively; and an urging unit configured to urge the opening and closing member in a direction opposite to a direction to close the opening and closing member, wherein the first engaged portion is arranged one side of the opening and closing member in a direction of a rotation shaft of the opening and closing member, and the second engaged portion is arranged the other side of the opening and closing member in a direction of a rotation shaft of the opening and closing member, and when the first engaging portion and the first engaged portion engage with each other and the second engaging portion and the second engaged portion engage with each other, the opening and closing member is held in a closed state, wherein, when the opening and closing member is being closed, urging force which the one side of the opening and closing member receives from the urging unit is larger than urging force which the other side of the opening and closing member receives from the urging unit, wherein, when the opening and closing member is closed from an opened state of the opening and closing member, the first engaged portion engages the first engaging portion by moving through the first engaging portion and the second engaged portion engages the second engaging portion by moving through the second engaging portion, and wherein a distance which the first engaged portion moves after the first engaged portion moves through the first engaging portion is shorter than a distance which the second engaged portion moves after the second engaged portion moves through the second engaging portion while the opening and closing member being closed from the opened state.

12. The image forming apparatus according to claim 11, wherein the urging unit includes a pressed portion configured to be pressed to the opening and closing member when the opening and closing member is being closed with respect to the apparatus main body, the pressed portion being pressed at the first engaged portion of the opening and closing member.

13. The image forming apparatus according to claim 12, further comprising:

a laser light irradiating unit configured to irradiate laser light to a photosensitive member; and a laser shutter capable of shielding the laser light emitted from the laser light irradiating unit, wherein the pressed portion is pressed to move the laser shutter and to enable the laser light irradiating unit to irradiate the laser light to the photosensitive member.

14. The image forming apparatus according to claim 12, further comprising:

a fixing unit configured to fix a toner image to a recording material; and a fixing shutter configured to be movable to a position to cover the fixing unit, wherein the pressed portion is pressed to move the fixing shutter to the position to cover the fixing unit.

* * * * *